US011703204B2

(12) United States Patent
Sieme

(10) Patent No.: US 11,703,204 B2
(45) Date of Patent: Jul. 18, 2023

(54) AIR GUIDE FOR COOLING AN ILLUMINATION DEVICE OF A VEHICLE, COOLING DEVICE AND ILLUMINATION DEVICE

(71) Applicant: Hella GmbH & Co. KGaA, Lippstadt (DE)

(72) Inventor: Joerg Sieme, Georgsmarienhuette (DE)

(73) Assignee: Hella GmbH & Co. KGaA, Lippstadt (DE)

( * ) Notice: Subject to any disclaimer, the term of this patent is extended or adjusted under 35 U.S.C. 154(b) by 0 days.

(21) Appl. No.: 17/310,490

(22) PCT Filed: Feb. 4, 2020

(86) PCT No.: PCT/EP2020/052727

§ 371 (c)(1),
(2) Date: Aug. 5, 2021

(87) PCT Pub. No.: WO2020/169335

PCT Pub. Date: Aug. 27, 2020

(65) Prior Publication Data

US 2022/0186905 A1 Jun. 16, 2022

(30) Foreign Application Priority Data

Feb. 20, 2019 (DE) ..... 10 2019 104 308.5

(51) Int. Cl.
*F21S 45/43* (2018.01)
*F21S 45/47* (2018.01)

(52) U.S. Cl.
CPC ..... *F21S 45/43* (2018.01); *F21S 45/47* (2018.01)

(58) Field of Classification Search
CPC ..... F21S 45/43
See application file for complete search history.

(56) References Cited

U.S. PATENT DOCUMENTS 11,022,270 B2 * 6/2021 Menn ..... F21S 45/435

FOREIGN PATENT DOCUMENTS

| | | | | |
|---|---|---|---|---|
| CN | 206656255 U | | 11/2017 | |
| DE | 102007043961 A1 | | 3/2009 | |
| DE | 102011089494 A1 | * | 6/2013 | ..... F21S 45/33 |
| DE | 102011089494 A1 | | 6/2013 | |
| DE | 102013001287 A1 | | 7/2014 | |
| DE | 102014117325 A1 | | 6/2016 | |
| EP | 2607784 A1 | | 6/2013 | |
| FR | 2946730 A1 | * | 12/2010 | ..... F21S 48/325 |
| FR | 2946730 A1 | | 12/2010 | |
| KR | 1020180064700 A | | 6/2018 | |

* cited by examiner

*Primary Examiner* — Matthew J. Peerce
(74) *Attorney, Agent, or Firm* — Husch Blackwell LLP

(57) ABSTRACT

An air guide is provided for cooling an illumination device of a vehicle. A single, essentially rigid air channel with an air inlet opening and at least one air outlet opening is provided. The air inlet opening is allocated to a blower and the at least one air outlet opening is allocated to at least one chamber or at least one chamber area of the illumination device. In order to improve the cooling of an illumination device of a vehicle, air channel is a free-form air channel, where the flow resistance of the free-form channel between the air inlet opening and each of the at least one air outlet opening is designed to be so low as to make it possible to deploy a blower in the form of an axial fan.

7 Claims, 2 Drawing Sheets

AIR GUIDE FOR COOLING AN ILLUMINATION DEVICE OF A VEHICLE, COOLING DEVICE AND ILLUMINATION DEVICE

CROSS REFERENCE

This application claims priority to PCT Application No. PCT/EP2020/052727, filed Feb. 4, 2020, which itself claims priority to German Application No. 10 2019 104308.5 filed Feb. 20, 2019, the entirety of both of which are hereby incorporated by reference.

FIELD OF THE INVENTION

The present invention relates to an air guide for cooling an illumination device of a vehicle, a cooling device for cooling an illumination device, and an illumination device for a vehicle.

BACKGROUND

Such air guides, cooling devices and illumination devices for vehicles are known from numerous embodiment versions of the state of the art. For example, the known air guides and cooling devices are designed to cool light sources of vehicle illumination devices in the form of LED light modules, for example of headlamps or lamps.

SUMMARY OF THE INVENTION

This is where the present invention comes in.

The task underlying the present invention is to improve the cooling of a vehicle's illumination device.

This task is solved by means of an air guide which are characterized in that the air channel is designed as a free-form air channel, where the flow resistance of the free-form air channel between the air inlet opening and each of the at least one air outlet openings is designed to be so low that a blower in the form of an axial fan can be deployed. Furthermore, this task is solved by means of a cooling device and an illumination device.

One material advantage of the invention is, in particular, the fact that the cooling of a vehicle's illumination device is improved. The design of the single air channel as a free-form air channel, where the flow resistance between the air inlet opening and each of the at least one air outlet openings is designed to be so low that a blower in the form of an axial fan can be deployed, makes it possible, firstly, to achieve a guiding of air that is optimized with regard to flow resistance. Secondly, the low level of pressure loss in the air channel makes it possible to use a cost-effective blower, for example an axial fan or the like. The optimized flow design of the air channel furthermore facilitates energy-saving operation of the blower and thus the cooling of the illumination device for the vehicle. This is advantageous in particular for vehicles with electric drive.

An inventive optimized free-form air channel can be designed according to the demands of each individual case, by means of flow simulations. for example. This means that the inventive air channel does not involve different hollow bodies with customary geometries being jointed to each other to guide a flow but a single free-form channel is created, for example on the basis of a flow simulation, that connects an air inlet opening of the inventive free-form air channel to which a blower is directly allocated to at least one air outlet opening of the inventive free-form air channel allocated to at least one chamber or at least one chamber area of the illumination device so as to guide the flow.

In principle the air channel can be selected at will within wide suitable limits. The same also applies for how it is manufactured. One especially advantageous refinement of the inventive air guide specifies that the air channel is designed as a single part. In this way, it is possible to reduce the flow resistance in the air channel using a simple design.

One advantageous refinement of the aforementioned embodiment specifies that the air channel is manufactured by means of blow molding, preferentially by means of extrusion blow molding. This makes it possible to manufacture the single-part air channel using simple production methods. In particular, extrusion blow molding is a tried-and-tested manufacturing technique suitable for high volumes. However, other manufacturing techniques are also conceivable, such as manufacturing using 3D printing techniques.

One advantageous refinement of the inventive air guide as an alternative to the two aforementioned embodiments specifies that the air channel is designed as two parts, where the two parts of the air channel are connected to each other by means of at least one fastener so as to be essentially leaktight. In this way, even very difficult manufacturing and/or installation conditions can be taken in account by means of the invention, for example.

As already mentioned above, the inventive single free-form air channel directly connects the air inlet opening of the free-form air channel allocated to the blower with the at least one air outlet opening of the free-form air channel allocated to one chamber or at least one chamber area of the illumination device. Correspondingly, a further advantageous refinement of the inventive air guide specifies that the air channel features a plurality of air outlet openings each allocated to individual chambers and/or chamber areas of the illumination device, where the respective air outlet opening is formed and arranged in such a way that a component of the illumination device to be cooled by air flowing through this air outlet opening can have the air directed at it in a manner for optimum heat transmission. This makes it unnecessary, for example, to deploy flow guide elements or the like in the at least one chamber or the at least one chamber area of the illumination device.

This means that the single free-form air channel is not merely connected to the at least one chamber or the at least one chamber area of the illumination device such as to guide the flow, but designed and arranged in such a way that the air guided therein can be directly aimed at the component of the illumination device to be cooled in a manner for optimum heat transmission.

One especially advantageous refinement of the inventive cooling device specifies that the blower is designed as an axial fan. Firstly, axial fans are cost-effective. Secondly, axial fans use less energy in comparison to radial fans, for example, thus facilitating an energy-efficient and cost-effective cooling of the vehicle's illumination device.

In principle, the illumination device can be selected at will within wide suitable limits in terms of type, functioning, material and dimensions. One advantageous refinement of the inventive illumination device specifies that a component to be cooled by means of the cooling device is designed as a heat sink, preferentially as a heat sink with cooling fins. The efficiency of the cooling of the illumination device is improved in this way.

One advantageous refinement of the aforementioned embodiment of the inventive illumination device specifies that the heat sink is connected with a light source of the illumination device so as to transfer heat. This means, for example, that high-performance light sources and high-performance light modules with such high-performance light sources can be efficiently cooled.

BRIEF DESCRIPTION OF THE DRAWINGS

Reference is now made more particularly to the drawings, which illustrate the best presently known mode of carrying out the invention and wherein similar reference characters indicate the same parts throughout the views.

DETAILED DESCRIPTION OF THE DRAWINGS

Figure 1:
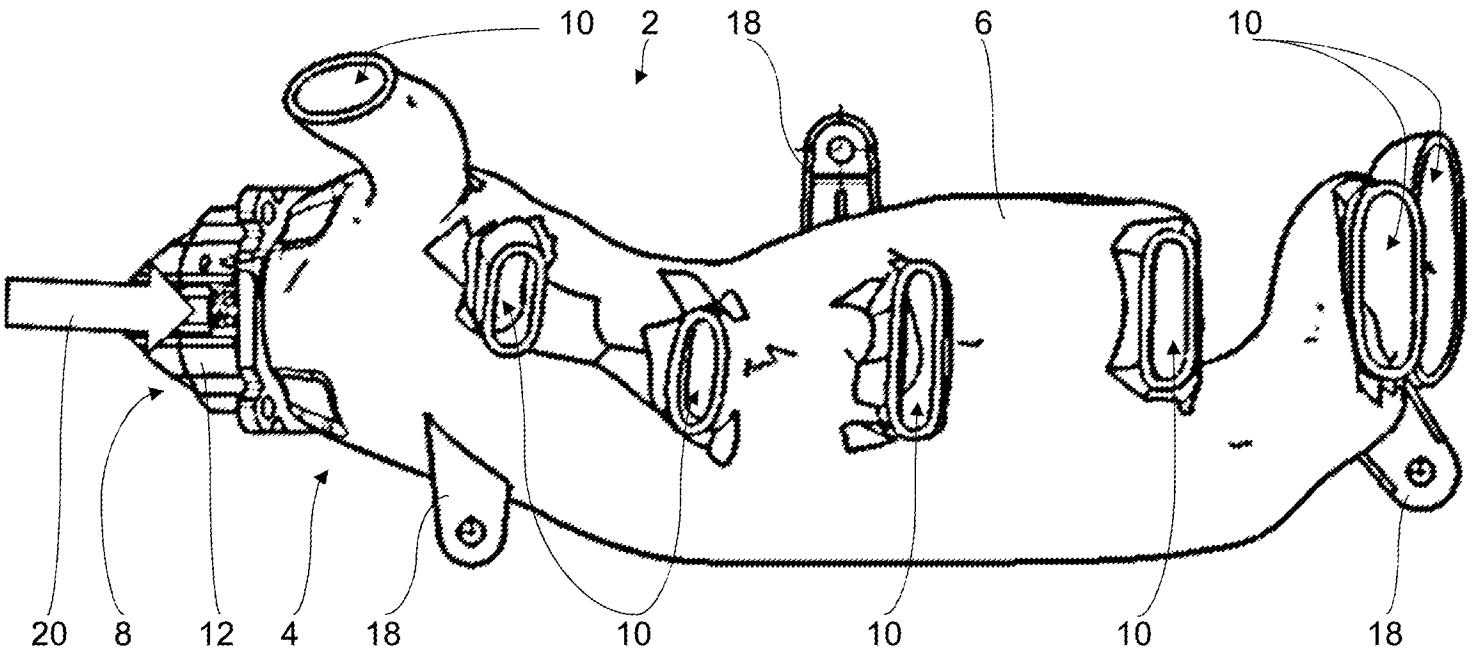
FIG. 1 is a front view of a sample embodiment of the inventive cooling device with the inventive air guide.

FIG. 1 shows a sample embodiment of the inventive cooling device for cooling an illumination device for a vehicle (not explicitly shown), as an example. The illumination device, for example a main headlamp, and the vehicle, for example a passenger vehicle, are not shown. The single cooling device 2 features a single air guide 4. The air guide 4 comprises a single, essentially rigid air channel 6 made of plastic with an air inlet opening 8 and a total of seven air inlet openings 10, where the air inlet opening 8 is allocated to a blower 12 in the form of an axial fan and the air outlet openings 10 are each allocated to a chamber area of the illumination device.

In the present sample embodiment, only a single cooling device 2 with only a single air guide 4 is therefore needed for cooling the inventive illumination device, where the air guide 4 furthermore features only a single air guide 6. According to the present sample embodiment, the invention makes it possible to greatly reduce the number of components. With this invention, this is also possible when more complex geometries are involved.

Figure 2:
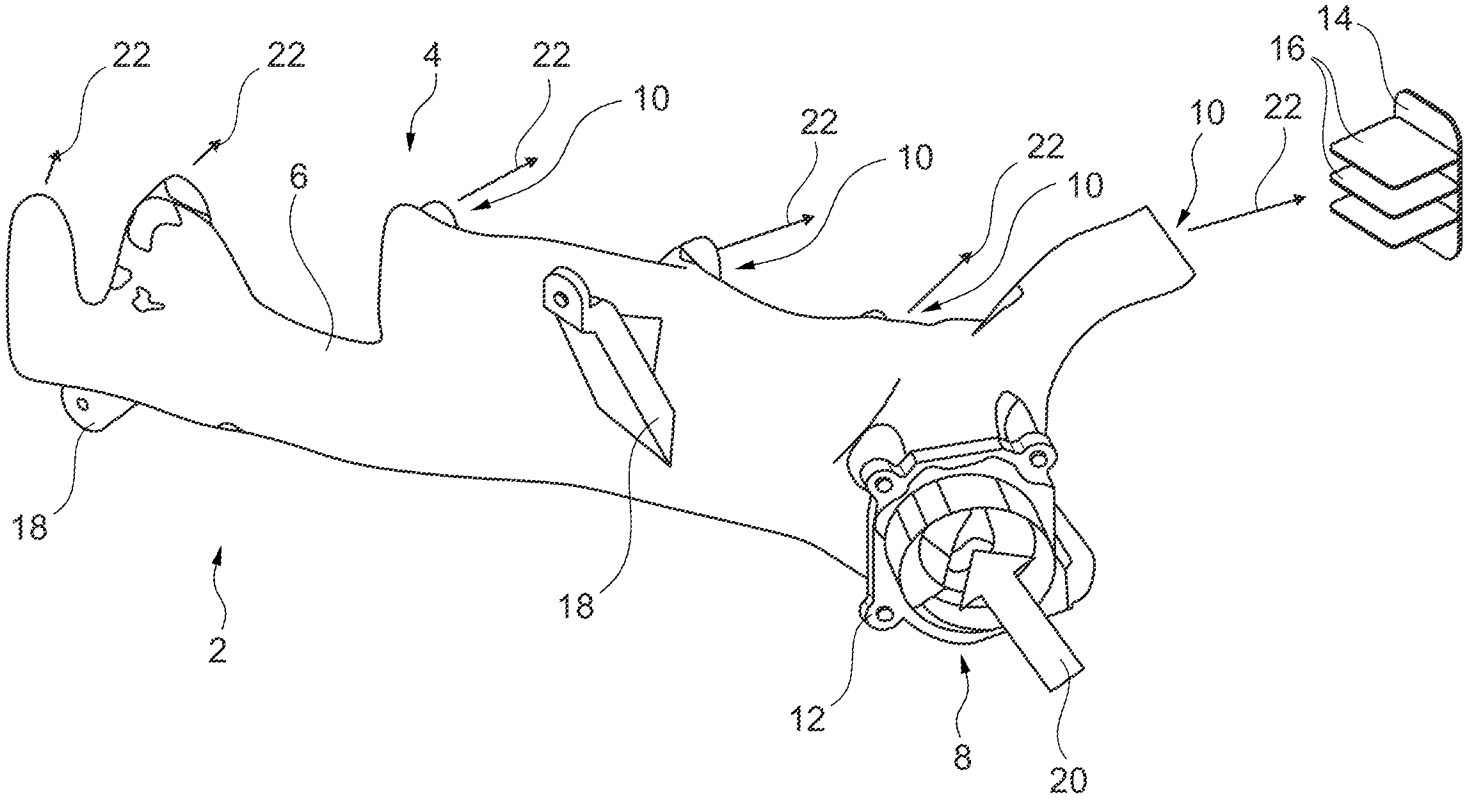
FIG. 2 illustrates the sample embodiment from FIG. 1 in a perspective view, looking at the back of the air guide.

The plurality of the air outlet openings 10 allocated in each case to the individual chamber areas of the illumination device are each designed and arranged in such a way that a component 14 of the illumination device to be cooled by air flowing through the respective air outlet opening 10 can have air aimed at it in a manner for optimum heat transmission. This means that additional flow guide elements, for example on the illumination device, are not absolutely necessary. FIG. 2 shows one of the components 14 to be cooled, where this component 14 is designed as a heat sink with cooling fins 16. The heat sink 14 with the cooling fins 16 makes contact so as to transfer heat with a light source of the illumination device in the form of an LED module. The LED module is not shown.

In accordance with the invention, the single air channel 6 takes the form of a free-form air channel, where the flow resistance of the free-form air channel 6 between the air inlet opening 8 and each of the seven air outlet openings 10 is designed to be so low that the axial fan 12 can be deployed as a blower for the free-form air channel 6.

Furthermore, the air channel 6 also features fastening brackets 18 for fastening the air channel 6 to a support in the vehicle (not shown).

In the present sample embodiment, the single air channel 6 is designed to be a single part, where the air channel 6 is manufactured as a blow molded part. The air channel 6 was manufactured by means of extrusion blow molding.

In the following, the inventive cooling device for cooling an illumination device for a vehicle with the inventive air guide is explained in more detail according to the present sample embodiment and on the basis of FIGS. 1 and 2.

The single air channel 6 of the single air guide 4 of the single cooling device 2 for the illumination device, is initially connected to the axial fan 12 in such a way that, when the cooling device 2 is in operation, the axial fan 12 sucks in air through the air inlet opening 8 of the air channel 6, guides it through the air channel 6 to the total of seven air outlet openings 10 and conveys it through the air outlet openings 10 into the chamber areas of the illumination device allocated to the respective air outlet openings 10. Furthermore, the air channel 6 is connected by the fastening brackets 18 to the vehicle's support in a force-transferring manner in a way known to a specialist. In doing so, the total of seven air outlet openings 10 are each aligned in the desired manner to the corresponding chamber area of the illumination device.

When the cooling device 2 is in operation, air is sucked into the air channel 6 by the axial fan 12 by means of the air inlet opening 8, guided through the air channel 6 through to the air outlet openings 10 and conveyed into the corresponding chamber areas of the illumination device by means of the air outlet openings 10. The air conveyed into the air channel 6 by means of the axial fan 12 is shown in FIGS. 1 and 2 by an arrow 20. Due to the design of the air channel 6 explained above, in particular the design and arrangement of the air outlet openings 10, air is aimed in a manner for optimum heat transmission at the components of the illumination device to be cooled by the air flowing through each of the air outlet openings 10. In this context, see the arrows 22 in FIG. 2 showing the individual main flow directions of the air flowing out of the respective air outlet opening 10. For example, the heat sink 14 shown in FIG. 2 has air aimed at it in such a way to provide optimum heat transfer from the heat sink 14 with the cooling fins 16 to the air aimed at the heat sink 14. Correspondingly, this achieves a very good level of cooling of the LED light module connected with the heat sink 14 so as to transfer heat, while reducing the effort involved. This means that additional flow guide elements, for example additional flow guide elements arranged on the illumination device, can be dispensed with.

The invention thus makes it possible to cool the inventive illumination device with less effort. This applies in particular to embodiments according to the present sample embodiment in which only a single cooling device with only a single air guide is used, where the air guide features only a single air channel.

The invention is not limited to the present sample embodiment. The invention can also be advantageously deployed with other vehicles for example. In this respect, use of the invention is not limited to land-based vehicles, the invention can also be advantageously used in seagoing vessels and aircraft. Likewise, the illumination device can be selected at will within wide suitable limits. Generally speaking, the inventive air guide and the inventive cooling device can also be deployed in other components from other fields of technology that require cooling.

Differing from the sample embodiment, it is conceivable that the air channel is formed in two parts, where the two parts of the air channel are connected to each other by a fastener so as to be essentially leaktight. For example, the two parts of the air channel can take the form of an upper part and a lower part designed as a kind of half shell. However, other types of separation are also possible.

LIST OF REFERENCE NUMBERS

2 Cooling device
4 Air guide

6 Air channel, designed as a free-form air channel
8 Air inlet opening
10 Air outlet opening
12 Blower, designed as an axial fan
14 Component to be cooled, designed as a heat sink
16 Cooling fins of the heat sink 14
18 Fastening brackets of the air channel 6
20 Main flow direction of the air that is conveyed into the air channel 6
22 Main flow direction of the air that is blown out in each case from air channel 6 by means of the air outlet openings 10

The invention claimed is:

1. An air guide for cooling an illumination device of a vehicle, the air guide comprising:

a rigid air channel in fluid communication with an air inlet opening and at least one air outlet opening;

an axial fan configured to induce a flow of air through the air inlet opening, the axial fan further configured to induce the flow of air through the rigid air channel, wherein the flow of air exits the rigid air channel at the at least one air outlet opening;

wherein the at least one air outlet opening includes:

an entrance portion positioned and located at an intersection of the at least one air outlet opening and the rigid air channel; and an exit portion positioned and located at a termination of the at least one air outlet opening, opposite the entrance portion;

wherein the entrance portion includes a free-form entrance cross section oriented perpendicular to a direction of airflow in the entrance portion;

wherein the exit portion includes a free-form exit cross section oriented perpendicular to a direction of airflow in the exit portion; and wherein the free-form entrance cross section is shaped differently than the free-form exit cross section.

2. The air guide in accordance with claim 1, wherein the air channel is formed as a single part.

3. The air guide in accordance with claim 2, wherein the air channel is manufactured via blow molding.

4. The air guide in accordance with claim 1, wherein the air channel is formed in two parts, where the two parts of the air channel are connected to each other by a fastener so as to be leak tight.

5. The air guide in accordance with claim 1, wherein the air channel features a plurality of air outlet openings each allocated to individual chambers and/or chamber areas of the illumination device, where each of the plurality of air outlet openings is formed and arranged such that a component of the illumination device to be cooled by air flowing through this air outlet opening can have the air directed at it.

6. The air guide in accordance with claim 1, wherein the at least one air outlet opening forms a plurality of air outlet openings arranged in a nonplanar configuration.

7. The air guide in accordance with claim 1, wherein the at least one air outlet opening further comprises a third portion positioned and located between the entrance portion and the exit portion, wherein the third portion includes a third free-form cross section oriented perpendicular to a direction of airflow in the third portion, and wherein the third free-form cross section is shaped differently than the free-form entrance cross section and the free-form exit cross section.

* * * * *